US007228777B2

(12) United States Patent
Morissette et al.

(10) Patent No.: US 7,228,777 B2
(45) Date of Patent: Jun. 12, 2007

(54) CARRIER ROPE APPARATUS AND METHOD

(75) Inventors: Alain Morissette, Granby (CA); Yves Martineau, Granby (CA)

(73) Assignee: William Kenyon & Sons, Inc., Piscataway, NJ (US)

( * ) Notice: Subject to any disclaimer, the term of this patent is extended or adjusted under 35 U.S.C. 154(b) by 0 days.

(21) Appl. No.: 10/807,071

(22) Filed: Mar. 22, 2004

(65) Prior Publication Data

US 2005/0204909 A1 Sep. 22, 2005

(51) Int. Cl.
*D04C 1/12* (2006.01)

(52) U.S. Cl. ..... 87/5; 87/8

(58) Field of Classification Search ..... 87/3, 87/5, 8, 11, 13
See application file for complete search history.

(56) References Cited

U.S. PATENT DOCUMENTS

| | | | | |
|---|---|---|---|---|
| 346,577 | A * | 8/1886 | Briggs | 57/211 |
| 3,805,667 | A | 4/1974 | Orser | |
| 3,960,050 | A * | 6/1976 | Eisler | 87/1 |
| 4,170,921 | A | 10/1979 | Repass | |
| 4,321,854 | A * | 3/1982 | Foote et al. | 87/6 |
| 4,640,178 | A | 2/1987 | Kurzbock | |
| 5,901,632 | A * | 5/1999 | Ryan | 87/13 |
| 5,931,076 | A | 8/1999 | Ryan | |
| 5,934,168 | A | 8/1999 | Feichtinger | |
| 6,945,153 | B2 * | 9/2005 | Knudsen et al. | 87/1 |
| 2005/0229770 | A1 * | 10/2005 | Smeets et al. | 87/8 |

* cited by examiner

*Primary Examiner*—Shaun R. Hurley
(74) *Attorney, Agent, or Firm*—Luis E. Arri

(57) ABSTRACT

The present invention is related to an apparatus and method for a carrier rope for use in the transport of paper webs in paper threading machine systems. The carrier rope constructed in accordance with the invention comprises a multi filament yarn assembly (A) having an initial twist, a composite yarn assembly (B) comprising mono filament yarn imparted around the multi filament yarn assembly via a second twist, wherein the multi filament yarn assembly (A) is not further twisted, a braided plait assembly (C) comprising a braid of composite yarn assemblies, and a carrier rope (D) comprising a braid of braided plait assemblies.

31 Claims, 6 Drawing Sheets

CARRIER ROPE APPARATUS AND METHOD

BACKGROUND

The present invention relates generally to the construction of ropes, and more particularly, to a carrier rope construction which is particularly suited for paper machine threading systems in the paper industry, in particular in paper, cardboard, tissue and pulp making machines or in paper, cardboard, tissue and pulp finishing machines. A carrier rope system is often used for threading the paper, cardboard, tissue or pulp web into and through the paper machine.

Carrier rope systems can be quite complex, utilizing multiple ropes of various sizes depending upon the machine operation. Typically, the carrier ropes twist, turn and travel up and down through the system, riding over a series of pulleys or sheaves. During operation, a carrier rope system is under constant tension and in constant contact with sheaves—a combination that leads to abrasion degradation of the carrier rope.

While the primary function of the carrier rope to grip a paper web and carry it along through the paper machine, a constant obstacle for the paper industry is improving the abrasion resistance of a carrier rope while maintaining effective grip properties of the rope.

U.S. Pat. No. 5,934,168, relates to improving the effective grip of cored braided ropes for the transfer of paper webs in paper machines. This rope sought to improve its effectiveness in gripping paper webs by forming raised portions over the rope circumference by using different multiple thread counts in the different running directions and/or the use of twisted laid fiber elements and/or the use of fibers with profiled fiber cross-sections and/or textured crimp fiber yarns.

U.S. Pat. No. 5,931,076 relates to the manufacture of large-diameter braided ropes using low elongation fibers without the need for multiple-stage twisting of the yarns. The rope is formed by the braiding of strands which themselves have been braided, as opposed to braiding twisted yarns.

What is needed therefore is a carrier rope for the threading of paper webs through paper machine systems having an improved grip and resistance to abrasion degradation.

SUMMARY

An important object of the invention is to provide a carrier rope having a multi filament yarn assembly imparted with an initial twist.

Another important object of the invention is to provide a carrier rope having mono filament yarn imparted with a twist around a multi filament yarn assembly to protect the multi filament yarn assembly.

Yet another important object of the invention is to provide a carrier rope constructed via multi-stage twisting of yarns, where the mono filament yarn is imparted around the multi filament yarn assembly via a second twist without further twisting the multi filament yarn assembly.

Another important object of the invention is to provide a carrier rope where the mono filament yarn imparted around the multi filament yarn assembly wraps around and protects the interior elements of the multi filament yarn assembly from abrasion degradation.

Still another important object of the invention is to provide a carrier rope with an improved grip surface for carrying along and transporting paper webs through paper machine systems.

Accordingly, these objects have been achieved through the manufacture of a carrier rope having a multi filament yarn assembly comprising a twist of a plurality of multi filament yarns, a composite yarn assembly comprising a twist of mono filament yarn around the multi filament yarn assembly, wherein the multi filament yarn assembly is not further twisted, a braided plait assembly comprising a braid of a plurality of composite yarn assemblies, and a braid of a plurality of braided plait assemblies.

This is accomplished by imparting a twist to a plurality of multi filament yarns forming a multi filament yarn assembly, imparting a second twist to mono filament yarn around the multi filament yarn assembly forming a composite yarn assembly, wherein the multi filament yarn assembly is not further twisted, braiding a plurality of the composite yarn assemblies forming a braided plait assembly, and braiding a plurality of the braided plait assemblies forming a carrier rope.

These objects have been further achieved in an alternative embodiment having a multi filament yarn assembly comprising a twist of a plurality of multi filament yarns, a braided plait assembly comprising a braid of a plurality of multi filament yarn assemblies, a composite braided plait assembly comprising a second twist of mono filament yarn around the braided plait assembly, wherein the braided plait assembly is not further twisted, and a braid of a plurality of composite braided plait assemblies.

This alternative embodiment is accomplished by imparting a twist to a plurality of multi filament yarns forming a multi filament yarn assembly, braiding a plurality of the multi filament yarn assemblies forming a braided plait assembly, imparting a second twist to monofilament yarn around the braided plait assembly forming a composite plait assembly, wherein the braided plait assembly is not further twisted, and braiding a plurality of the composite plait assemblies forming a carrier rope.

BRIEF DESCRIPTION OF THE DRAWINGS

The construction designed to carry our the invention will hereinafter be described, together with features thereof.

The invention will be more readily understood from reading of the following specification and by reference to the accompanying drawings forming a part thereof, wherein an example of the invention is shown and wherein.

DETAILED DESCRIPTION

Figure 1:
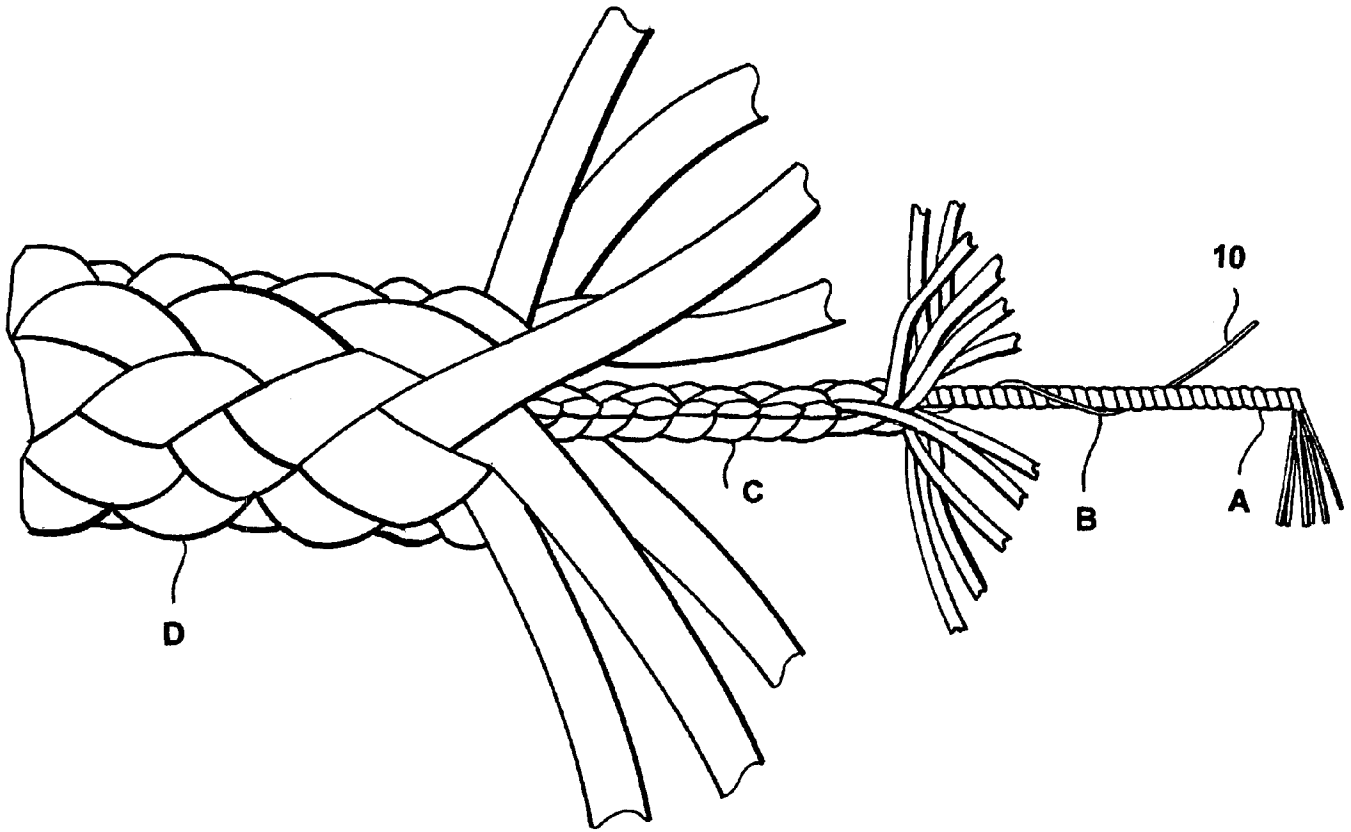
FIG. 1 is an elevational view illustrating an end portion of a carrier rope constructed in accordance with the present invention, showing systematically the manner in which mono filament yarn is twisted around a multi filament yarn assembly forming a composite yarn assembly, the manner such composite yarn assemblies are braided together to form braided plait assemblies, and the manner such braided plait assemblies are braided together to form the carrier rope.
Figure 2:
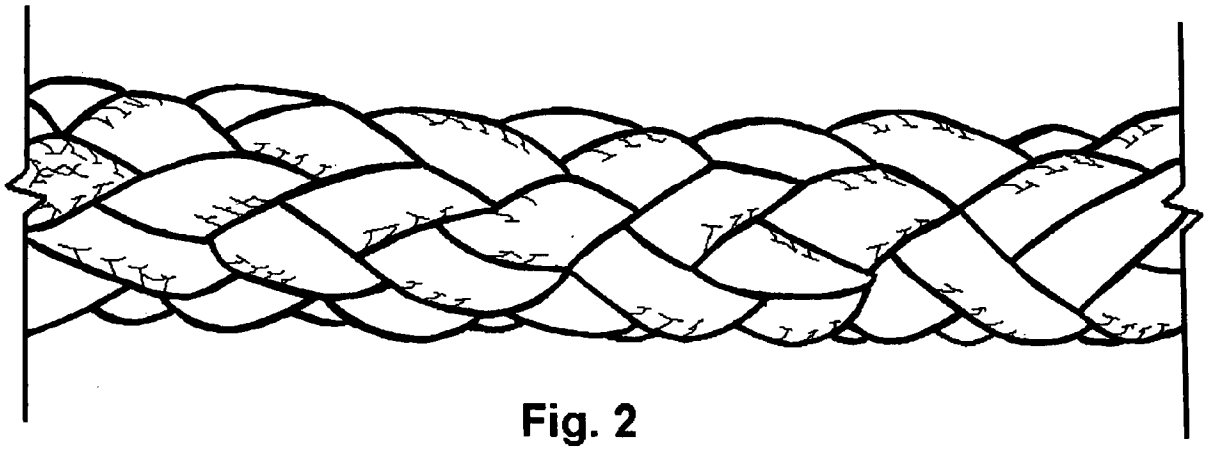
FIG. 2 is an elevational view illustrating a length of the carrier rope of FIG. 1 in accordance with the present invention.
Figure 3:
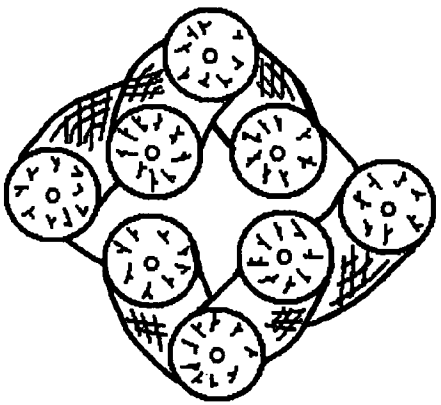
FIG. 3 is a transverse view illustrating an interior of the carrier rope of FIG. 1 in accordance with the present invention.
Figure 4:
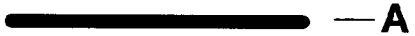
FIG. 4 is an elevational view illustrating a multi filament yarn assembly in accordance with the present invention.
Figure 5:
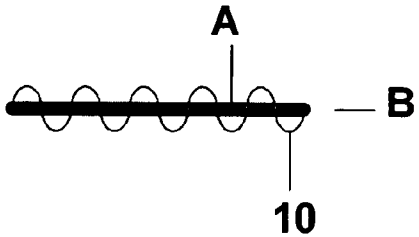
FIG. 5 is an elevational view illustrating a composite yarn assembly showing the mono filament yarn twisted around the multi filament yarn assembly of FIG. 4 in accordance with the present invention.
Figure 6:
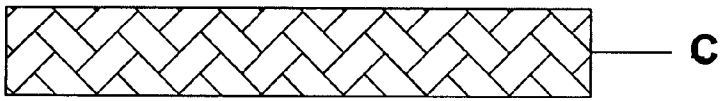
FIG. 6 is an elevational view illustrating a braided plait assembly showing a braid of the composite yarn assemblies of FIG. 5 in accordance with the present invention.
Figure 7:
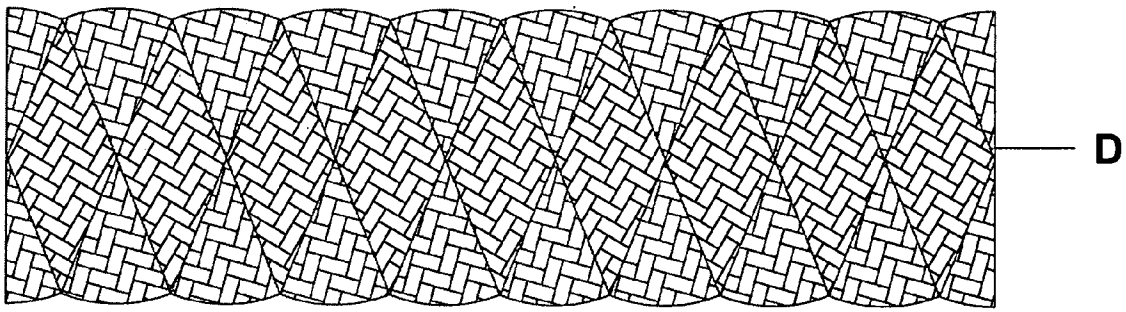
FIG. 7 is an elevational view illustrating a carrier rope showing a braid of the braided plait assemblies of FIG. 6 in accordance with the present invention.

The drawings illustrate a carrier rope for use in the transport of paper webs in paper threading machine systems. The carrier rope constructed in accordance with the invention comprises a multi filament yarn assembly A, a composite yarn assembly B, a braided plait assembly C, and a carrier rope D.

The method of manufacturing a carrier rope in accordance with the present invention begins with the construction of the multi filament yarn assembly A and the composite yarn assembly B. Multi filament yarn assembly A comprises multi filament nylon or polyester yarns which are fed into a twisting apparatus and imparted with an initial twist. When the multi filament yarn assembly comprises nylon multi filament yarns, the multi filament yarn assembly weight range will preferably comprise 2800–4900 tex. The multi filament yarn assembly weight range for polyester multi filament yarns will preferably differ by approximately 10%, in the range from 2500–5400 tex.

The initial twist imparted to the multi filament yarn assembly for both nylon and polyester multi filament yarns will preferably range from 20–30 twists per foot (tpf). The multi filament yarn assembly can be twisted to form either Z-twist or S-twist multi filament yarn assemblies. A Z-twist yarn is a yarn that is twisted to the left, or in a counter-clockwise direction, and conversely, an S-twist yarn is a yarn that is twisted to the right, or in a clockwise direction.

In a preferred embodiment, the multi filament yarn assembly comprises 4 ends of 700 dtex multi filament nylon 6.6 which is imparted with an initial twist of 22 tpf in equal Z and S-twist yarns.

Composite yarn assembly B comprises multi filament yarn assembly A and mono filament yarn 10 comprising either nylon or polyester. The multi filament yarn assembly A is again fed into a twisting apparatus wherein the mono filament yarn 10 is imparted around the multi filament yarn assembly A via a second twist. This second twist step, wherein the mono filament yarn 10 is twisted around the multi filament yarn assembly, is effected without further twisting the multi filament yarn assembly A. The mono filament yarn may be imparted with either a Z twist or an S twist for forming Z twist and S twist composite yarn assemblies. The advantage of using a multi-stage twist process for imparting a twist of mono filament around the multi filament yarn assembly is to ensure the mono filament yarn wraps around and protects the interior elements of the multi filament yarn assembly from abrasion degradation. If the multi filament yarns and mono filament yarns were twisted together in a single step, the mono filament yarn would merely blend into such a yarn assembly, instead of being twisted around it.

Whether the mono filament yarn comprises nylon or polyester mono filament yarn, the mono filament yarn will preferably range in diameter from 0.20 to 0.32 mm. It has been found that mono filament yarn having a diameter less than this range does not sufficiently extend out of the braided plait assembly to protect the multi filament yarn assembly and have the desired grip for effective use in paper threading machine systems. Further, it has been found that mono filament having a diameter greater than this range is very difficult to process, as these yarns resist twisting and tend to return to their original untwisted shape when handled prior to heat setting the yarn.

In a preferred embodiment the composite yarn assembly B comprises a single 0.24 mm diameter mono filament nylon 6 yarn twisted around the multi filament yarn assembly A in either a Z or S twist.

Braided plait assembly C comprises a braid of composite yarn assemblies B. In a preferred embodiment, braided plait assembly B comprises a braid of eight Z twist ends and eight S twist ends of the composite yarn assembly B. The braided plait assembly is preferably braided on a 16 carrier braider, although to vary the rope flatness a 32 carrier braider could also be used. The typical pick repeat in a 16 carrier braided plait assembly comprises 102 picks per foot (ppf).

Figure 8:
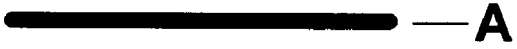
FIG. 8 is an elevational view illustrating a multi filament yarn assembly in accordance with the present invention.
Figure 9:
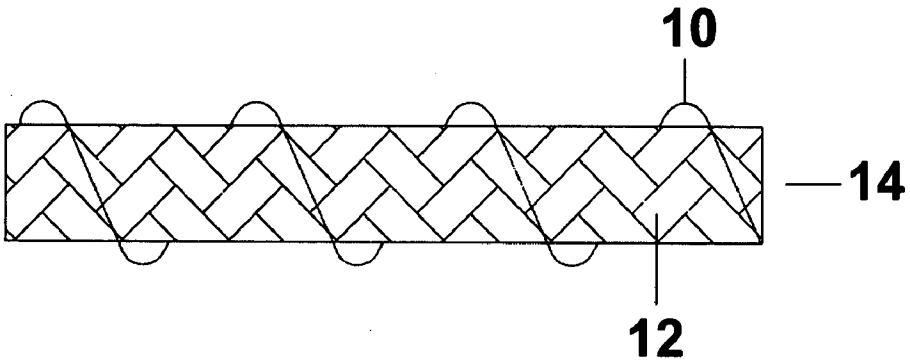
FIG. 9 is an elevational view illustrating a composite braided plait assembly showing the mono filament yarn twisted around a braided plait assembly of the multi filament yarn assemblies of FIG. 8 in accordance with an alternative embodiment of the present invention.
Figure 10:
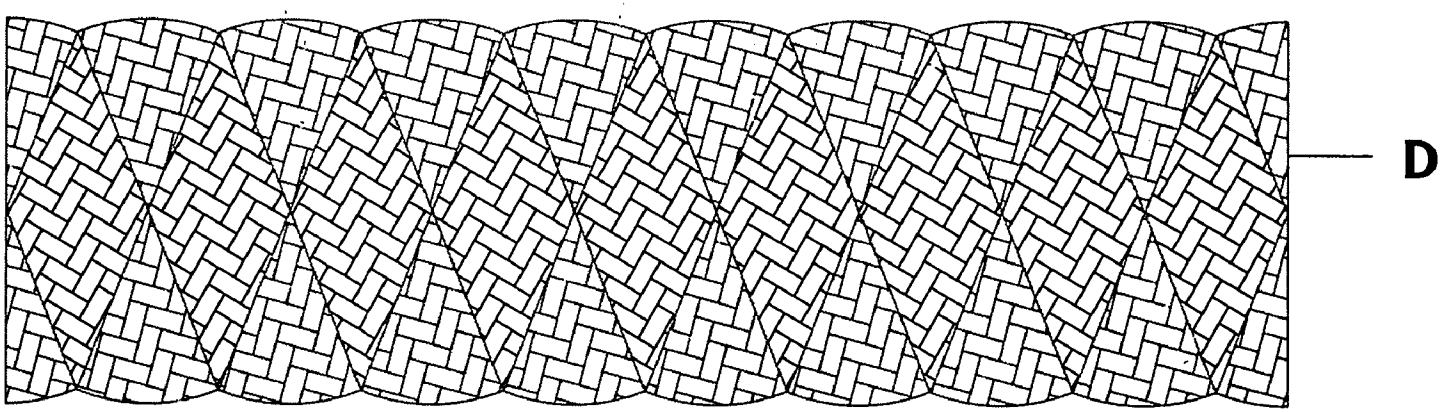
FIG. 10 is an elevational view illustrating a carrier rope showing a braid of the composite braided plait assemblies of FIG. 9 in accordance with an alternative embodiment of the present invention.
Figure 11:
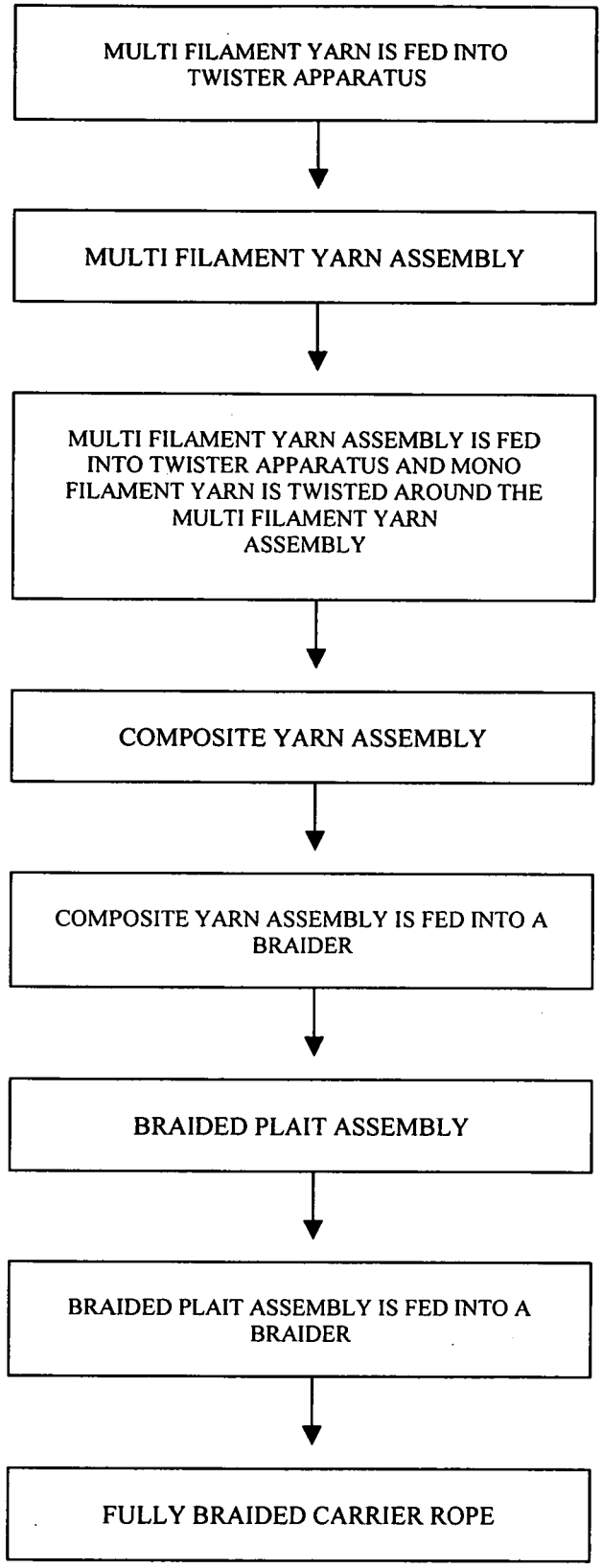
FIG. 11 is a diagrammatic view illustrating a method of manufacturing the carrier rope in accordance with the invention.
Figure 12:
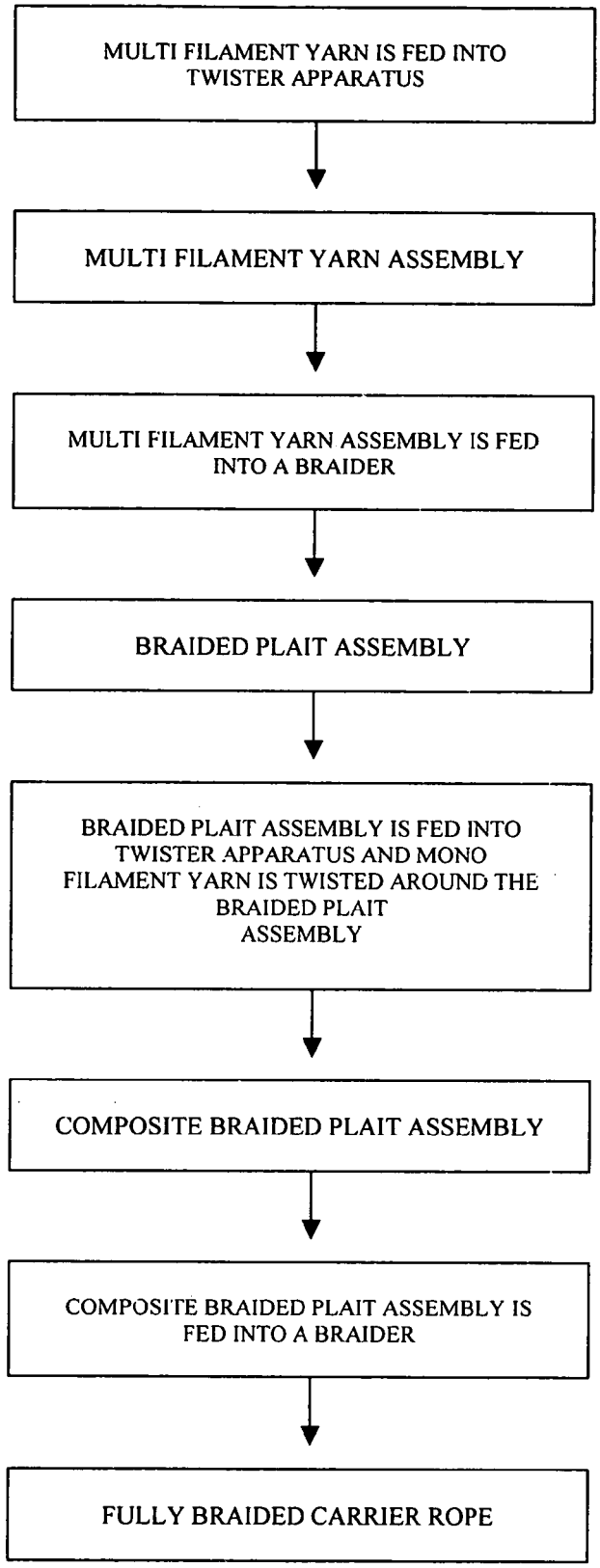
FIG. 12 is a diagrammatic view illustrating a method of manufacturing the carrier rope in accordance with an alternative embodiment of the present invention.

With reference to FIGS. 8–10, and 12, an alternative embodiment is shown wherein the composite yarn assembly B is not formed, and multi filament yarn assemblies A are braided to form a braided plait 12. The braided plait is fed into a twisting apparatus wherein mono filament yarn 10 is imparted around the braided plait 12 via a second twist to form a composite braided plait assembly 14. This second twist step, wherein the mono filament yarn 10 is twisted around the braided plait 12, is effected without further twisting the braided plait. The mono filament yarn may be imparted with either a Z twist or an S twist for forming Z twist and S twist composite braided plait assemblies. The advantage of using a multi-stage twist process for imparting a twist of mono filament around the braided plait, is to ensure the mono filament yarn wraps around and protects the interior elements of the braided plait from abrasion degradation. If the multi filament yarns of the braided plait and mono filament yarns were twisted together in a single step, the mono filament yarn would merely blend into such a yarn assembly, instead of being twisted around it.

Whether the mono filament yarn assembly comprises nylon or polyester mono filament yarn, the mono filament yarn assembly diameter range will preferably comprise 0.20–0.32 mm. In a preferred embodiment of this alternative the composite braided plait assembly 14 comprises a single 0.24 mm diameter mono filament nylon 6 yarn twisted around the braided plait 12 in either a Z or S twist.

In another alternative embodiment, the composite yarn assembly B can be braided about a core, forming a cored braided plait assembly. A twist of three strands of 8400 tex nylon forms a 3/16" core about which the composite yarn assembly may be braided to form a cored braided plait assembly. Cored braided plait assemblies can then be braided to form a cored carrier rope, or yet in another embodiment, can be braided over a core themselves forming yet another cored carrier rope construction.

In yet another alternative embodiment braided plait assembly B may be manufactured via knitting.

In a preferred embodiment the carrier rope D comprises a braid of eight ends of the braided plait assemblies. The carrier rope is preferably braided on a 8 carrier braider, although a 16 carrier braider could also be used.

Heat setting, either of the individual yarns or assemblies prior to final braiding, or of the braided carrier rope, is advantageous for several reasons: first, heat setting physically eliminates air gaps within the individual assemblies or braided carrier rope to ensure a perfect lay of the plaits; second, heat setting imparts a "memory" to the individual yarns, assemblies or braided carrier rope; and third, heat setting stabilizes the shrinking and stretching of the individual yarns, assemblies or braided carrier rope, preventing excessive dynamic elongation of the rope in the paper machine threading system, making the yarns, assemblies or rope as stable as possible.

A protective coating may be applied to either the individual yarns or assemblies prior to final braiding, or to the braided carrier rope. While it is contemplated that the numerous compounds and solutions known in the art to provide abrasion resistance may be used, in a preferred embodiment the protective coating comprises a polyurethane based solution which is impregnated into the rope fibers. Preferably the protective coating is applied by dipping the individual yarns, assemblies or braided carrier rope in a polyurethane based solution bath and squeezing off the excess solution. Other application mechanisms such as spraying, rolling, or foaming may also be used for applying the protective coating. Regardless of when in the construction process the protective coating is applied, the protective coating functions to protect the carrier rope from abrasion or chemical degradation.

Further, the protective coating can be dyed a variety of colors such that carrier ropes of various colors may be produced. Typically a paper threading machine systems use multiple carrier ropes, normally for distinct phases of the operation. Colored carrier ropes are advantageous for being able to assign a specific color rope to a specific operation such that the multiple ropes can easily be individually identified whether during operation, for maintenance, or replacement.

While a preferred embodiment of the invention has been described using specific terms, such description is for illustrative purposes only, and it is to be understood that changes and variations may be made to the carrier constructed in accordance with the invention that has mono filament yarn twisted around a multi filament yarn assembly wherein the multi filament yarn assembly is not further twisted, its parts, and methods of manufacture, without departing from the spirit or scope of the following claims.

The invention claimed is:

1. A method of manufacturing a carrier rope, comprising the steps of:

imparting a twist to a plurality of multi filament yarns forming a multi filament yarn assembly;

imparting a second twist to monofilament yarn around the multi filament yarn assembly forming a composite yarn assembly, wherein the multi filament yarn assembly is not further twisted;

braiding a plurality of the composite yarn assemblies forming a braided plait assembly; and braiding a plurality of the braided plait assemblies forming a carrier rope.

2. The method of manufacture of claim 1, wherein the multi filament yarn assembly comprises 4 ends of 700 denier multi filament nylon 6.6.

3. The method of manufacture of claim 1, wherein the multi filament yarn assembly comprises equal Z twist and S twist yarns.

4. The method of manufacture of claim 1, wherein the multi filament yarn assembly is imparted with an initial twist comprising 22 twists per foot.

5. The method of manufacture of claim 1, wherein the multi filament yarn assembly is imparted with an initial twist comprising from 20 to 30 twists per foot.

6. The method of manufacture of claim 1, wherein the multi filament yarns forming the multi filament yarn assembly comprise nylon.

7. The method of manufacture of claim 1, wherein the multi filament yarns forming the multi filament yarn assembly comprise polyester.

8. The method of manufacture of claim 1, wherein the multi filament yarn assembly comprises from 2500 to 5400 tex.

9. The method of manufacture of claim 1, further comprising the step of applying a protective coating to the multi filament yarn assembly.

10. The method of manufacture of claim 9, further comprising the step of dipping the multi filament yarn assembly in a polyurethane based solution bath.

11. The method of manufacture of claim 1, wherein the monofilament yarn comprises from 0.20 to 0.32 mm in diameter.

12. The method of manufacture of claim 1, wherein the monofilament yarn is 0.24 mm in diameter.

13. The method of manufacture of claim 1, wherein the composite yarn assembly comprises Z twist monofilament yarns.

14. The method of manufacture of claim 1, wherein the composite yarn assembly comprises S twist monofilament yarns.

15. The method of manufacture of claim 1, wherein a single mono filament yarn is twisted around the multi filament yarn assembly, wherein the multi filament yarn assembly is not further twisted.

16. The method of manufacture of claim 1, wherein the braided plait assembly comprises equal Z twist and S twist ends of the composite yarn assembly.

17. The method of manufacture of claim 1, further comprising the step of heat setting the individual braided plait assemblies prior to braiding the braided plait assemblies to form the carrier rope.

18. The method of manufacture of claim 1, further comprising the step of pre-stretching the individual braided plait assemblies prior to braiding the braided plait assemblies to form the carrier rope.

19. The method of manufacture of claim 1, further comprising the step of braiding the composite yarn assemblies on a 16 carrier braider to form the braided plait assembly.

20. The method of manufacture of claim 19, wherein the 16 carrier braided plait assembly comprises a pick repeat of 1.02 ppf.

21. The method of manufacture of claim 1, further comprising the step of braiding the composite yarn assemblies on a 32 carrier braider to form the braided plait assembly.

22. The method of manufacture of claim 1, further comprising the step of braiding the composite yarn assembly about a core forming a cored braided plait assembly.

23. The method of manufacture of claim 22, wherein the core comprises three strands of 8400tex nylon.

24. The method of manufacture of claim 1, further comprising the step of braiding the braided plait assembly on an 8 carrier braider.

25. The method of manufacture of claim 24, wherein the 8 carrier rope comprises a pick repeat of 21 ppf.

26. The method of manufacture of claim 1, further comprising the step of braiding the braided plait assembly on a 16 carrier braider.

27. The method of manufacture of claim 1, further comprising the step of braiding the braided plait assembly about a core forming a cored carrier rope.

28. The method of manufacture of claim 1, further comprising the step of applying a protective coating to the carrier rope.

29. The method of manufacture of claim 28, further comprising the step of dipping the carrier rope in a polyurethane based solution bath.

30. A method of manufacturing a carrier rope comprising the steps of:

imparting a twist to four ends of 700 dtex multi filament nylon 6.6 in equal Z and S twist yarns forming a multi filament yarn assembly;

imparting a second twist to a single monofilament nylon 6 yarn around the multi filament yarn assembly forming a composite yarn assembly, wherein the multi filament yarn assembly is not further twisted;

braiding eight Z twist ends and eight S twist ends of the composite yarn assembly forming a braided plait assembly;

braiding eight ends of the braided plait assemblies forming a carrier rope;

applying a protective coating to the carrier rope; and heat setting the carrier rope.

31. A method of manufacturing a carrier rope comprising the steps of:

imparting a twist to a plurality of multi filament nylon yarns in equal Z and S twist yarns forming a multi filament yarn assembly;

imparting a second twist to monofilament nylon yarn around the multi filament yarn assembly forming a composite yarn assembly, wherein the multi filament yarn assembly is not further twisted;

braiding sixteen ends of the composite yarn assembly forming a braided plait assembly;

braiding eight ends of the braided plait assembly forming a carrier rope;

applying a protective coating; and heat setting the carrier rope.

* * * * *